United States Patent [19]

Budd et al.

[11] Patent Number: 4,844,830

[45] Date of Patent: Jul. 4, 1989

[54] LUBRICANT AND METHOD OF COLD-ROLLING ALUMINUM

[75] Inventors: Michael K. Budd, Kingston, Canada; Mark H. Foster, Banbury, England

[73] Assignee: Alcan International Limited, Montreal, Canada

[21] Appl. No.: 32,029

[22] Filed: Mar. 30, 1987

Related U.S. Application Data

[63] Continuation of Ser. No. 796,891, Nov. 12, 1985, abandoned.

[30] Foreign Application Priority Data

Nov. 13, 1984 [GB] United Kingdom ..... 8428621

[51] Int. Cl.[4] ..... C10M 129/40; C10M 129/70

[52] U.S. Cl. ..... 252/56 R; 252/52 R

[58] Field of Search ..... 252/56 R, 49.3, 52 R

[56] References Cited

U.S. PATENT DOCUMENTS 3,932,671 12/1975 Krepp ..... 252/49.5
4,116,872 9/1978 Jahnke ..... 252/32.7 E
4,132,662 1/1979 Starwold ..... 252/56 R
4,151,102 4/1979 Baur ..... 252/56 R
4,191,658 3/1980 Jahnke ..... 252/32.7 E

OTHER PUBLICATIONS

Derkach, V. L., et al., "Effect of Surface Active Substances on the Force Parameters in the Rolling of D16AM Aluminum Alloy Sheet," *Light Metal Age* Dec. 1979.

*Primary Examiner*—William R. Dixon, Jr.
*Assistant Examiner*—E. McAvoy
*Attorney, Agent, or Firm*—Cooper & Dunham

[57] ABSTRACT

Load-bearing additives for lubricants for cold-rolling aluminum, particularly foil rolling down to a thickness below 50 microns, comprise a methyl ester of a saturated straight-chain C10–C14 carboxylic acid, particularly methyl dodecanoate. A saturated straight-chain C10–C14 alcohol, or a saturated straight-chain C8–C14 carboxylic acid may also be present. The lubricants permit greater rolling speeds and improved foil properties during and after annealing.

16 Claims, No Drawings

LUBRICANT AND METHOD OF COLD-ROLLING ALUMINUM

This is a continuation of application Ser. No. 796,891, filed Nov. 12, 1985, now abandoned.

Aluminium and alloys thereof (hereinafter called simply aluminium) are conventionally hot-rolled down to a thickness of about 6 mm using a water-based lubricant, and thereafter cold-rolled to a desired final thickness using a hydrocarbon oil-based lubricant, and finally annealed. Cold-rolling comprises the stages of sheet rolling down to about 120 microns and of foil rolling thereafter down to a final thickness which may be as low as 3 microns. Below about 50 microns, the surfaces of the rolls are (by virtue of elastic deformation) in contact in regions where no foil is present, and this is known as closed-gap rolling.

Load-bearing additives have for many years been included in lubricants for cold-rolling aluminium. This invention is concerned with the use of methyl dodecanoate and related compounds as load-bearing additives for cold-rolling, particularly foil rolling, and particularly closed-gap foil rolling, of aluminium.

A widely used load-bearing additive for foil rolling consists of a mixture of butyl palmitate/stearate and dodecanoic (lauric) acid. Due to its high boiling point (343° C.) butyl palmitate/stearate is very difficult to remove completely during annealing. At preferred temperatures in the range 260°–300° C. annealing consequently takes a very long time, especially if the foil is wide (more than 1 m). At higher annealing temperatures up to 330° C. degradation of the butyl palmitate/-stearate occurs and the resulting polymers are even more difficult to remove. Over-annealing at these temperatures brings the risk of tackiness and consequent foil breakages during conversion.

Rolling foil with an acceptable surface topography for some products requires the use of high lubricant additive levels which increase the viscosity of the lubricant resulting in reduced mill speed and excess residual oil which is particularly difficult to remove during annealing.

British Patent Specification No. 819073 discusses the above problem in terms of the brown strains that are produced when cold rolled sheet is annealed, and proposes as a solution to the problem, the use of a long-chain saturated aliphatic alcohol. And indeed aliphatic alcohols such as dodecanol/tetradecanol have achieved considerable success as load-bearing additives for cold-rolling, particularly sheet rolling, of aluminium. But although the British Patent Specification suggests that lauryl alcohol (dodecanol) is suitable for foil rolling, it is now generally accepted that long-chain alcohols alone are not ideal as load-bearing additives for foil rolling.

An article in Light Metal Age, December 1978 pages 32–33, compares various long-chain alcohols and the methyl esters of long-chain acids as load-bearing additives for cold-rolling aluminium sheet. Actual rolling tests are performed using sheet of starting thickness 0.9 mm. As expected load-bearing capacity is shown to increase for both classes of additives with increasing number of carbon atoms in the molecule; but alcohols of given chain length are shown to be substantially superior to methyl esters of acids of the same chain length. The known tendency of additives having more than 14 carbon atoms per molecule to give rise to brown stains on annealing is also noted.

The industry has long needed to be able to coldroll aluminium, particularly aluminium foil and especially under closed-gap conditions, using a lubricant which has the load-bearing, friction and viscosity properties to permit rapid passage of metal at high rates of reduction per pass, so as to give rise to a product having good surface finish without problems on annealing. It is an object of this invention to fulfil that need.

In one aspect, the invention provides a method of cold-rolling aluminium foil down to a thickness below 50 microns, which method comprises providing on the surface of the aluminium being deformed a hydrocarbon oil-based lubricant comprising a hydrocarbon oil containing a methyl ester of a saturated straight-chain C10–C14 carboxylic acid as a load-bearing additive.

In another aspect, the invention provides a lubricant for cold-rolling aluminium comprising a hydrocarbon oil base and an ester/alcohol or ester/acid load-bearing additive, wherein the ester is a methyl ester of a saturated straight-chain C10–C14 carboxylic acid, the alcohol is a saturated straight-chain C10–C14 alcohol, and the acid is a saturated straight-chain C8–C14 carboxylic acid.

As the ester used, methyl dodecanoate is preferred, but the methyl esters of decanoic and tetradecanoic acids are also useful. Among alcohols, dodecanol and tetradecanol are preferred but decanol is also possible. Among acids, dodecanoic acid is preferred, but octanoic, decanoic and tetradecanoic acids are also possible. Commercial purity compounds may be used; these generally contain proportions, sometimes substantial proportions, of higher and/or lower homologues as impurities, which are taken herein as part of the identified compound. Compounds having 11 or 13 carbon atoms in the long chain are at present less readily available and are therefore unlikely to be commercially viable alternatives. Alcohols and esters having less than 10 carbon atoms in the long chain, and acids having less than 8 carbon atoms in the long chain, do not in general have the load-bearing capacity required for cold-rolling at high speed. Compounds having more than 14 carbon atoms in the long chain tend to give rise to brown stains when the rolled metal is annealed. The boiling points of the compounds concerned, in so far as they are recorded, are (in °C.):

| | Number of Long Chain C Atoms | | | |
|---|---|---|---|---|
| | 8 | 10 | 12 | 14 |
| Alcohol | | 229 | 255 | 263 |
| Carboxylic Acid | 237 | 269 | 292 | — |
| Methyl Ester | | 224 | 261 | — |

All the compounds are volatile (with or without decomposition) at the temperatures (260°–300° C.) generally used for annealing aluminium sheet or foil.

Cold-rolling of aluminium is performed to maximise rolling speed at a desired thickness reduction per pass without manifest distortion or shape effects in the metal. A limiting factor is the metal temperature in the nip, and the load-bearing capacity of the lubricant at elevated temperatures (100°–200° C.) is therefore crucial. Our experience is that the load-bearing capacities of long-chain alcohols, esters and acids all fall off at elevated temperature, but that, for a given carbon chain length, acids are superior to esters which are in turn superior to alcohols.

Although long-chain alcohols are very good load-bearing additives for sheet-rolling aluminium, they are not really suitable by themselves for foil-rolling, particularly under closed-gap conditions, because of the higher temperatures involved. Although long-chain carboxylic acids have good load-bearing properties at elevated temperature, they react with metal to produce soaps which reduce lubricant friction and create other problems downstream; thus carboxylic acids also are not really suitable by themselves for foil-rolling. As load-bearing additives, methyl esters of the acids avoid the disadvantages of both alcohols and acids, and can advantageously be used alone, or more particularly in conjunction with alcohols or acids, for foil rolling aluminium.

The total concentration of load-bearing additive is generally 0.1%–15%, particularly 0.5%–10%, by volume on the volume of the lubricant. When an ester/acid combination is used, the lubricant preferably contains 0.1%–10% of the ester and 0.1%–3% of the acid, percentages being by volume and the volume of the ester generally being greater than that of the acid. When an ester/alcohol combination is used, the lubricant preferably contains 0.1%–5% by volume of the ester and from 0.1%–10% by volume of the alcohol.

The lubricant includes a hydrocarbon base oil whose nature is not critical to the invention and which may be conventional. Such an oil generally has a flash point (closed cup) above 80° C., a boiling range ideally not more than 30° C., a final boiling point in the range 250° C. to 280° C., and a viscosity of 0.75–4.25 cSt at 40° C.; and generally consists of linear and branched chain aliphatic hydrocarbons with a low aromatic content, substantially neutral, and essentially free of unsaturated hydrocarbons and sulphur compounds. The lubricant may also include other conventional additives in conventional amounts. Specifically, an antioxidant may be included, preferably of the hindered tertiary-butyl-phenol type, preferably at a concentration of 0.1%–0.25%.

The lubricant is generally used in a form consisting essentially of the hydrocarbon base oil with the load-bearing and other additives discussed.

The load-bearing additives with which this invention is concerned have the following features, many of which are not possessed by prior load-bearing additives:

(a) High load-bearing capacity, even under foil and closed-gap rolling conditions. It is surprising that methyl dodecanoate can provide load-bearing performance equivalent to that of the butyl esters of longer-chain fatty acids such as butyl stearate, and the reason is believed to be that the methyl group is less sterically hindering than ethyl or butyl groups.

(b) Low viscosity in lubricant oil solution. For example, lubricants containing methyl dodecanoate generally have lower viscosity than comparable lubricants containing butyl stearate. The use of a lower viscosity lubricant should permit the achievement of either an increase in rolling speed without loss of surface quality, or an improvement in surface quality at the same rolling speed.

(c) Adequate friction in lubricant oil solution. It is known that carboxylic acids react with the metal to produce soaps which disfigure the metal surface. The soaps also reduce the friction of the lubricant and hence reduce the speed at which rolling can be effected. In the load-bearing additives with which the present invention is concerned, acids are preferably absent or added in only minor proportions.

(d) Volatile at 300° C., and in many cases at 270° C., to avoid staining problems during annealing.

(e) Relatively non-volatile at mill operating temperatures which may be as high as 100°–200° C.

(f) Adequately high flash point (at least 80° C.) to reduce fire hazard.

(g) Food and Drug Administration approval or equivalent, for use in foil rolling lubricants.

(h) The methyl esters are liquid at ambient temperature, which simplified preparation of the lubricant. By contrast, butyl stearate is not wholly liquid at ambient temperature.

(i) High purity with no bad-tasting contaminants. For example, some commercial grades of butyl-palmitate/-stearate are known to leave residual contaminants on the surface of can stock with a taste effect which is particularly detectable in canned beer. Use of methyl dodecanoate in place of butyl palmitate/stearate enables this effect to be minimised.

The lubricant may be preheated to 40°–70° C. This not only reduces the viscosity so as to permit faster passage through the rolls, but also provides a measure of stress relief as the metal is deformed. Conventional forces acting on the rolls (which may for example be from 130–170 tonnes when rolling sheet or foil in the width range 800–1300 mm), may be used to achieve thickness reductions of 40–60% per pass at rolling speeds of up to 1000m/minute with good surface finish and without manifest shape problem.

The following Examples illustrate the invention.

EXAMPLE 1

Lubricants were made up consisting of 1% or 8% of different load-bearing additives in a synthetic hydrocarbon base oil sold under the Trade Mark Petresa C14. The formulations and viscosities of the lubricants at various temperatures are set out in Table 1.

TABLE 1

| Load-bearing Additive (amount) | Viscosity (cSt) at Temperature | | |
|---|---|---|---|
| | 20° C. | 70° C. | 130° C. |
| None (base oil) | 3.0 | 1.4 | 0.7 |
| Butyl Stearate (1%) | 3.1 | 1.4 | 0.8 |
| Tetradecanol (1%) | 3.0 | 1.4 | 0.8 |
| Methyl dodecanoate (1%) | 3.0 | 1.3 | 0.7 |
| Butyl Stearate (8%) | 3.3 | 1.5 | 0.8 |
| Tetradecanol (8%) | 3.6 | 1.5 | 0.8 |
| Methyl dodecanoate (8%) | 3.0 | 1.4 | 0.7 |

At operating temperatures of 70° C. and above, lubricants containing methyl dodecanoate are shown to have viscosities below those of lubricants containing the same amount of butyl stearate.

A disc compression test was used to measure the load bearing properties of the selected lubricants. For elevated temperatures a furnace was placed around the tool set. The experiments were carried out using AA 3003 discs, of 32 mm diameter and 5 mm thickness. All discs used were annealed for one hour at 500° C. to give uniform hardness of 28+2 V.P.N.

The experimental procedure involved application of the lubricant under test to both tool and disc surfaces. The tool set was then assembled with the disc centrally located between the upper and lower tools and then placed between the jaws of an Avery 100-tonne press. At temperatures above ambient, the discs and tools were allowed to stabilise for 5 minutes. A load of 45 tonnes was then applied at a constant strain rate of 90 tonnes/minute. After a dwell time of 2 s, the jaws were opened and the disc removed from the tool set for examination. Initial thickness of the disc and the thickness after deformation were measured and the percentage reduction calculated. As metal pick up occurred on the tool faces it was necessary to compress ten preliminary specimens for each lubricant with the following four being used to measure the load bearing capacity. At elevated temperatures it was only necessary to compress four preliminary specimens before taking measurements.

The results of the experiments are set out in Table 2.

TABLE 2

| Load-bearing Additive (amount) | Percentage Reduction at Temperature | | |
|---|---|---|---|
| | 20° C. | 70° C. | 130° C. |
| None (base oil) | 26.0 | 27.5 | 31.0 |
| Butyl Stearate (1%) | 26.5 | 28.0 | 31.5 |
| Tetradecanol (1%) | 35.0 | 30.0 | 32.0 |
| Methyl Dodecanoate (1%) | 26.0 | 28.0 | 31.5 |
| Butyl Stearate (8%) | 44.5 | 39.0 | 34.5 |
| Tetradecanol (8%) | 49.5 | 48.5 | 37.5 |
| Methyl Dodecanoate (8%) | 42.5 | 37.0 | 34.5 |

Large percentage reductions denote good load-bearing performance. These results suggest that, at operating temperatures of 70° C. and above, the performance of methyl dodecanoate is substantially the same as that of butyl stearate. However, laboratory tests which are capable of accurately and reliably predicting the performance of load-bearing additives under commercial closed-gap conditions, do not exist. These results therefore merely indicate that tetradecanol and methyl dodecanoate are suitable for cold-rolling and not clearly unsuitable for use under closed-gap conditions.

EXAMPLE 2

Lubricants were made up consisting of various combinations of two load-bearing additives in a hydrocarbon oil sold under the Trade Mark Aral WZ 25. The formulations and viscosities of the lubricants at various temperatures are set out in Table 3.

TABLE 3

| Additive Combinations in Aral WZ 25 Base Oil Viscosity cSt | | | |
|---|---|---|---|
| | 20° C. | 70° C. | 130° C. |
| Base Oil | 3.0 | 1.3 | 0.7 |
| 0.5% Dodecanoic Acid 8% Butyl Stearate | 3.4 | 1.4 | 0.8 |
| 0.5% Dodecanoic Acid 8% Methyl Dodecanoate | 3.0 | 1.3 | 0.7 |
| 7.2% Tetradecanol 0.8% Methyl Dodecanoate | 3.5 | 1.4 | 0.7 |
| 4% Tetradecanol 4% Methyl Dodecanoate | 3.2 | 1.3 | 0.7 |

The load-bearing properties of the lubricants were measured by the procedure described in Example 1, and the results are set out in Table 4.

TABLE 4

| Additive Combinations in Aral WZ 25 Base Oil Percentage Reduction Obtained in load-bearing capacity test | | | |
|---|---|---|---|
| | 20° C. | 70° C. | 130° C. |
| Base Oil | 30.0 | 30.5 | 32.5 |
| 0.5% Dodecanoic Acid 8% Butyl Stearate | 47.0 | 41.5 | 43.0 |
| 0.5% Dodecanoic Acid 8% Methyl Dodecanoate | 47.0 | 41.5 | 42.5 |
| 7.2% Tetradecanol 0.8% Methyl Dodecanoate | 48.0 | 43.0 | 44.0 |
| 4% Tetradecanol 4% Methyl Dodecanoate | 48.5 | 43.0 | 39.5 |

The results show that replacement of butyl stearate by methyl dodecanoate in the known butyl stearate/dodecanoic acid blend enabled the load-bearing capacity of the system to be maintained while the viscosity was substantially reduced.

Mixtures of tetradecanol and methyl dodecanoate also exhibited similarly high load-bearing capacity, while the viscosities were lower at mill operating temperatures.

EXAMPLE 3

Plant trials of a load bearing system of 2.5% methyl dodecanoate and 0.5% dodecanoic acid in Aral WZ 25 base oil were carried out: Foil was rolled to 8, 15, 20 and 40 microns. After rolling, a part of each batch of material was annealed using the normal annealing cycles while the remaining coils were annealed for shorter times. After annealing, the coils were evaluated for variations across the width in wettability, tackiness and electrical potential (to give an indication of residual lubricant). After printing, the adhesion characteristics of the printing ink were measured; in the case of the thicker, heat seal lacquered material, peel strength measurements were also made. The results obtained with the trail batch of foil were comparable to those obtained with material rolled with the previous lubricant formulation (in which the load-bearing additive was a carboxylic acid/high boiling ester combination).

The new lubricant formulation is less sensitive to annealing practices than the normal formulations. It may be possible to reduce the annealing cycles of certain products and still produce material which will be within the specification for wettability, tackiness, adhesive bond strength etc. This is not possible with foil rolled with the normal lubricant formulation where reductions in the annealing cycle cause problems in conversion.

EXAMPLE 4

Plant trials of a load-bearing system of 0.96% dodecanol and 0.20% methyl dodecanoate in BA 1100 kerosene based oil were carried out. Rolling oil temperature was maintained at 48° C. Typical entry gauge on the finishing mill was 100 microns. Typical foil gauges produced were 8–12 and 15 microns.

A marginal increase in rolling speed at around 500 metres per minute was noted at all foil gauges, in comparison with the lubricant previously used in the plant (in which the load-bearing additive was an alcohol/high boiling ester combination). Here again it was possible to reduce the annealing cycle with respect to time, and in the case of wide products with respect to temperature also. After annealing, the foil surfaces were completely wetted by water, where previously alcohol/water mixtures had been required. The heat seal lacquer peel strengths were also higher and more consistent than was obtainable using the previous foil rolling lubricant.

We claim:

1. A method of cold rolling aluminium sheet down to a thickness below 120 microns, which method comprises providing on the surface of the aluminium being deformed a lubricant comprising a hydrocarbon oil base and an ester/alcohol load-bearing additive, wherein the ester is a methyl ester of a saturated straight-chain C10–C14 carboxylic acid and the alcohol is a saturated straight-chain C10–C14 alcohol.

2. A method as claimed in claim 1, wherein the ester is methyl dodecanoate.

3. A method as claimed in claim 1, wherein the aluminium sheet is aluminium foil which is rolled down to a thickness below 50 microns.

4. A method as claimed in claim 1, wherein the load-bearing additive contains 0.1% to 5% by volume of the ester and from 0.1% to 10% by volume of the alcohol.

5. A method of cold-rolling aluminium sheet down to a thickness below 120 microns, which method comprises providing on the surface of the aluminium being deformed a lubricant comprising a hydrocarbon oil base and an ester/acid load-bearing additive, wherein the ester is a methyl ester of a saturated straight-chain C10 to C14 carboxylic acid, and the acid is a saturated straight-chain C8 to C14 carboxylic acid.

6. A method as claimed in claim 5, wherein the ester is methyl dodecanoate.

7. A method as claimed in claim 5, wherein the aluminium sheet is aluminium foil which is rolled down to a thickness below 50 microns.

8. A method as claimed in claim 5, wherein the load-bearing additive contains 0.1% to 10% of the ester and 0.1% to 3% of the acid, percentages being by volume.

9. A method as claimed in claim 8, wherein the volume of the ester is greater than that of the acid.

10. A lubricant for cold-rolling aluminium sheet below 120 microns thickness, comprising a hydrocarbon oil base and an ester/alcohol load-bearing additive, wherein the ester is a methyl ester of a saturated straight-chain C10 to C14 carboxylic acid and the alcohol is a saturated straight-chain C10 to C14 alcohol.

11. A lubricant as claimed in claim 10, wherein the ester is methyl dodecanoate.

12. A lubricant as claimed in claim 10, wherein the load-bearing additive contains 0.1% to 5% by volume of the ester and from 0.1% to 10% by volume of the alcohol.

13. A lubricant for cold-rolling aluminium comprising a hydrocarbon oil base and an ester/acid load-bearing additive, wherein the ester is a methyl ester of a saturated straight-chain C10 to C14 carboxylic acid, and the acid is a saturated straight-chain C8 to C14 carboxylic acid.

14. A lubricant as claimed in claim 13, wherein the ester is methyl dodecanoate.

15. A lubricant as claimed in claim 14, wherein the load-bearing additive contains 0.1% to 10% of the ester and 0.1% to 3% of the acid, percentages being by volume.

16. A lubricant as claimed in claim 15, wherein the volume of the ester is greater than that of the acid.

* * * * *